United States Patent [19]

Soulos

[11] 4,105,206

[45] Aug. 8, 1978

[54] WEIGHTLIFTING GAME

[76] Inventor: Steven T. Soulos, 55 Alfred Drowne Rd., Barrington, R.I. 02806

[21] Appl. No.: 763,228

[22] Filed: Jan. 27, 1977

[51] Int. Cl.[2] ..... A63F 9/00; A63H 13/04

[52] U.S. Cl. ..... 273/85 R; 46/120; 273/1 R

[58] Field of Search ..... 273/1 R, 1 E, 1 M, 85 R, 273/85 C, 85 D, 85 E, 85 F, 86 F; 46/119, 120, 142; 114/215

[56] References Cited

U.S. PATENT DOCUMENTS

| | | | |
|---|---|---|---|
| 143,993 | 10/1873 | Newcomb | 114/215 X |
| 1,371,845 | 3/1921 | Borgeson | 273/86 F |
| 2,431,552 | 11/1947 | Gosnell | 273/85 F |
| 2,433,224 | 12/1947 | Koci et al. | 273/85 F |
| 2,799,501 | 7/1957 | Barbolla | 273/85 F |
| 4,006,555 | 2/1977 | England et al. | 46/119 |

*Primary Examiner*—Paul E. Shapiro
*Attorney, Agent, or Firm*—Salter & Michaelson

[57] ABSTRACT

A game based on guessing whether a simulated weightlifter can lift a given weight, comprising a figure in the form of a simulated weightlifter movable from a rest or bent-over position to a lift position by means of the tensioning of a cord or strand, tension limiting means associated with said cord whereby if a pre-set tension level is not exceeded, winding of the cord will cause the figure to move to lift position, while if the pre-set level is exceeded, the cord loses its tension and the figure collapses to its rest position. The placing of weights on the figure varies the tension required to reach lift position, and means are provided for randomly varying the pre-set tension level.

24 Claims, 9 Drawing Figures

WEIGHTLIFTING GAME

BACKGROUND AND SUMMARY OF THE INVENTION

The present invention relates to a device for performing work, such as lifting, and is particularly adapted for incorporation in an overall game structure wherein a toy figure simulates a human weightlifter and is adapted to move between rest and lift positions thereof by the tensioning of a cord.

Toys, including those in the form of animal or human shapes which are movable between various activity positions by means of the alternate tensioning and relaxing of cords strung through the body portions thereof, are generally known. Such constructions do not, however, lend themselves to incorporation within a game structure having competitive play value.

It is accordingly a primary object of the present invention to provide a device of the aforementioned type which is constructed so that the progressive tensioning of a cord or strand operatively connected thereto is adapted to move the device from a first to a second position, provided that a predetermined tension limit is not exceeded.

A further object of the invention is the provision of a game incorporating a lifting device in the form of a simulated human weightlifter which is adapted to move between rest and lift positions thereby simulating realistic weightlifting motions.

A still further object of the present invention is the provision of a game incorporating a weightlifting figure of the immediately aforementioned type in which enhanced game interest is achieved by randomly varying the predetermined tension limit above which the cord will become slack, thus preventing the figure from moving to its lift position.

Another object of the present invention is the provision of a novel structural configuration in the form of a simulated weightlifter figure including leg, torso and arm portions which progressively move through simulated "clean and jerk" weightlifting movements as the figure moves from rest to lift position.

Still another object of the present invention is the provision of a novel tensioning assembly which has general application in the tensioning of a strand up to a predetermined tension limit, thereafter enabling an abrupt but controlled slackening of such strand.

A still further object of the invention is the provision of a novel device for randomly varying the predetermined tension limit of a tensioning device of the immediately aforementioned type, wherein the player participants of a game incorporating such novel constructions will not be able to readily observe such changes, accordingly enhancing the play value of the game.

These and other objects of the present invention are accomplished by the provision of a figure in the form of a weightlifter having interconnected leg, torso and arm portions which are adapted for interrelated pivotal movement therebetween to simulate weightlifting movements by the progressive tensioning of a strand operatively associated therewith. A strand tensioning member functions to maintain tension on the strand as the latter is progressively wound or tightened, thereby causing the figure to move from rest to lift position. The tensioning member is movably mounted and is adapted to abruptly move from a first or tension inducing position to an alternate position when strand tension of a predetermined level has been exceeded so as to permit the strand to go slack and thus cause the figure to collapse, that is, return to its rest position. The means for restraining the tensioning member in its first position includes a leaf spring having a terminal portion adapted to contact and restrain the tensioning member. The terminal portion of the leaf spring is deflectable so as to permit the tensioning member to move abruptly therepast when the predetermined tension limit has been exceeded. Furthermore, the rigidity of such leaf spring terminal portion is variable by means of a follower movable to different positions along the extent thereof. The follower mechanism is in turn controlled by a crank arm and detent mechanism in such a manner that its position and thus the variable predetermined tension limit is random and not readily observable by game participants.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
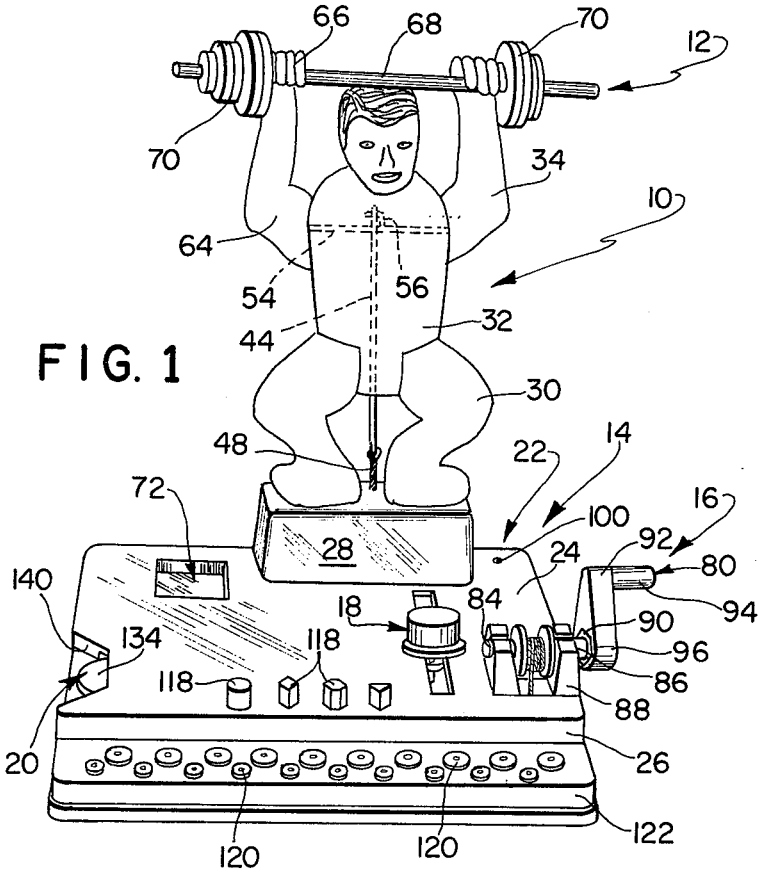
FIG. 1 is an overall view of a game apparatus incorporating the several novel features of the present invention.

Referring to the drawings and particularly FIG. 1 thereof, the overall configuration of a game apparatus 10 is shown as generally including a simulated weightlifting figure 12 and a base structure 14 including tensioning means 16, tension limiting means 18 and tension limit varying means 20. Such means are appropriately mounted within a housing 22 including an upper platform 24 having side walls 26 downwardly extending from the periphery thereof. The game apparatus 10 further includes a support or pedestal 28 on which the figure 12 is adapted to be positioned and the figure 12 itself preferably includes leg, torso and arm portions 30, 32 and 34 respectively, which body portions are at least to some extent adapted to move relative to each other so as to simulate the progressive body actions of a weightlifter when moving weights from a rest to a lift position. Naturally, the particular movements and the progression thereof which such body portions perform are dependent on the particular type of lift being performed, the figure 12 as illustrated specifically being adapted to perform the so-called "clean and jerk" lift. However, it should be understood that other type lifts could be provided for by suitable modification of the various body portions of the figure's construction. It should also be brought out that in the broader forms of the invention the figure need not necessarily simulate a weightlifter since the progressive lift movements from rest to lift position of the present invention may be incorporated in other devices, game apparatus and the like, including, for example, simulated or toy machinery such as steam shovels, backhoes and the like, provided such are designed to accommodate and function pursuant to cord tensioning of the type under consideration in the present case.

With the foregoing in mind, the particular construction of the weightlifting figure 12 herein illustrated and the manner in which the various body portions thereof cooperate to perform the "clean and jerk" weightlift will now be more fully explained by simultaneous reference to FIGS. 1 and 4 through 8 of the drawings.

The figure 12 as shown in FIG. 1 simulates an actual person, whereas it will be understood that in FIGS. 4 through 8 the various body portions of the simulated weightlifter are in more simplified diagrammatic form. As will be noted, the leg portions 30 are disposed upon the pedestal 28 in a generally upright attitude and are fixedly connected thereto by any suitable means, such as by being integrally molded thereto. The leg portions 30 are thus preferably fixed in position with respect to the base portions 14 of the game apparatus. The various body portions 30, 32 and 34 as well as remaining portions of the body 12 may be molded from resinous plastic material such as polyethylene, polypropylene or high impact polystyrene, as by blow molding or injection molding techniques, or a combination of both.

Figure 4:
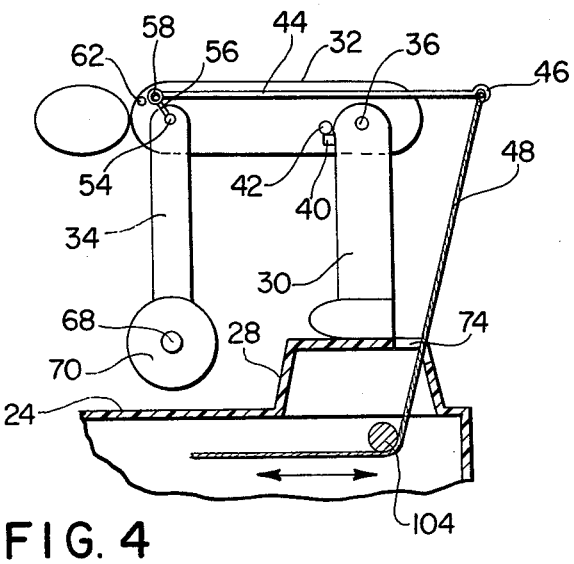
FIGS. 4 through 8 sequentially illustrate the progressive movement of a simulated weightlifter figure in stylized form as it moves from a full rest or collapsed position depicted in FIG. 4 to a full lift or erect position as shown in FIG. 8.

As will be seen most clearly in FIGS. 4 through 8, the torso portion 32 is pivotally attached to the leg portions 30 around a lower pivot point 36 generally in the vicinity of the lifter's hip and the torso is free to move from a rest or collapsed position as illustrated by FIG. 4 of the drawing to simulate the initial bending position assumed by lifters preparing to execute the "clean" portion of the "clean and jerk" lift. Additionally, forward stop means shown generally at 38 are provided to limit the forward bending movement of the torso portion 32 with respect to the leg portions 30, which means include a stop 40 carried by leg portions 30 and adapted to be engaged by pin or bar 42 carried by the torso portion 32 to limit the forward bending movement of the latter, as clearly illustrated in FIG. 4.

The torso 32 further includes a rigid rod 44 longitudinally orientated at least partially within the internal body portions thereof and adapted for longitudinal slidable movement therewith for a purpose which will hereinafter be apparent. The lower end of the rigid rod 44 extends outwardly from the leg or lower pivot 36 and is provided with an eyelet 46 or other means for attaching a strand 48. The extent to which the lower end of the rod extends out past the lower or hip pivot 36 is dependent on the mechanical advantage or lift ratios required to facilitate movement of the body 32 from the rest position of FIG. 4 to the upright position of FIG. 6. Also the rod 44 may be laterally offset with respect to the torso so that the downward extension of the rod especially in the lift position will at least be partially masked by the leg portions. Alternatively, by disproportionately distributing a larger weight in the rear of the torso, the rod 44 could be entirely disposed within the torso.

The strand 48 generally is in the form of a string or cord of a highly flexible but non-elastic nature so as to be operable for progressive tensioning to control the movement of the figure to an erect or lift position and its return to a rest position.

Figure 6:
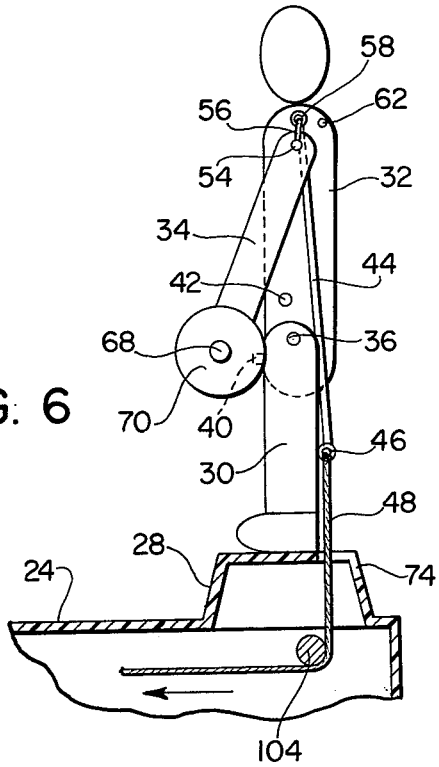
Figure 7:
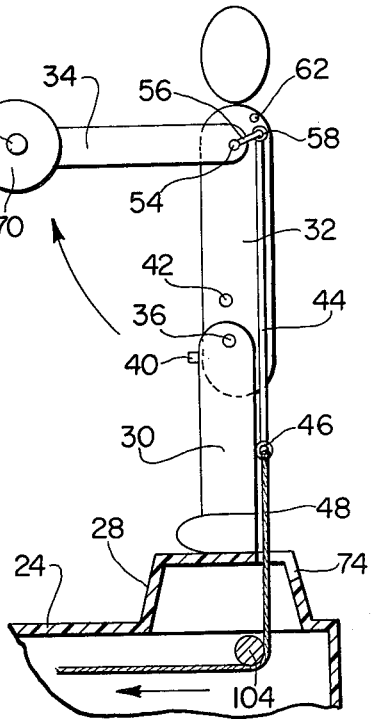
Figure 8:
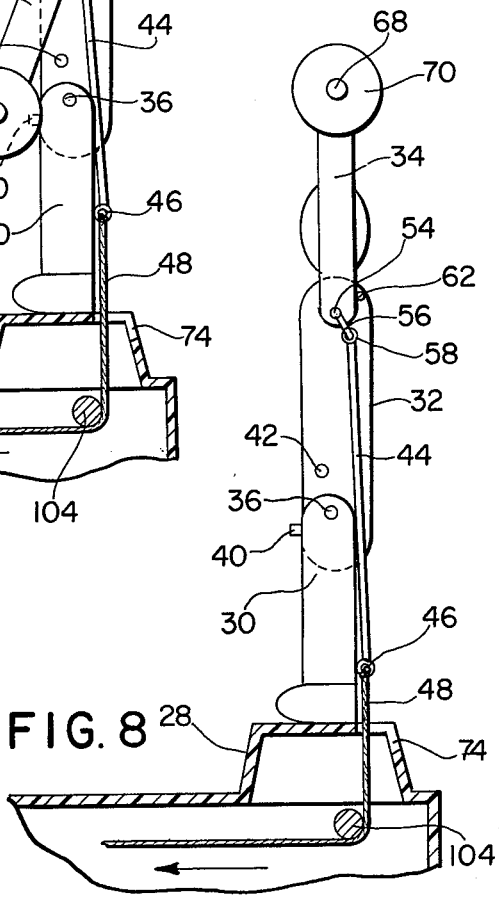

The arm portions 34 are disposed on opposite sides of the torso 32 and are adapted for upward swinging movement with respect thereto once the figure 12 has assumed the upright position as shown in FIG. 6 by means of an upper pivot assembly 50 constructed in the form of a bell crank mechanism. Such mechanism is operatively connected to an upper terminal portion or head 52 of the rod 44 which in turn is disposed eccentrically and preferably slightly rearwardly of a transverse extending rod 54. The rod 54 is fixedly mounted within the torso 32 in any suitable manner so as to permit at least limited rotation thereof.

Figure 3A:
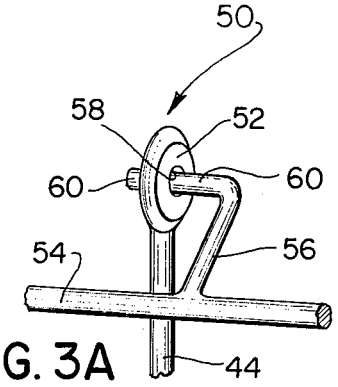
FIG. 3A is an enlarged fragmentary perspective view which forms a part of my invention.

The arm portions 34 are in turn fixedly secured to the rod 54 and can thus move, i.e. swing, as a unit therewith upon such rotation of the rod 54. A crank arm or link 56 is fixedly attached to the rod 54 generally centrally thereof and extends outwardly therefrom into pivotal connection with the upper terminal portion or head 52 of the rod 44 as shown in FIG. 3A wherein the link 56 is depicted as terminating in a pin 60 in turn rotatably received within a bore 58 extending through the head 52. The rod 54 accordingly forms the pivot point about which the arm positions 34 are adapted to swing. Thus a downward pull on rod 44 causes link 56 to move in an arcuate path about the pivot formed by shaft 54 and by reason of the rigid connection between link 56 and shaft 54 results in the rotation of shaft 54. This rotation in turn due to its rigid connection with the arms 34, caused the arms to swing. The above described action is best seen by sequential reference to FIGS. 6, 7 and 8 of the drawings wherein the figure 12 is shown progressively moving arms from a simulated "clean" position to a fully upright or successful lift position wherein the arms 34 are generally in line with the remaining body portions, further movement to an overcenter position being prevented by an additional stop 62. During the movement of the body from the rest position shown in FIG. 4 to the full lift position shown in FIG. 8, should the progressive tensioning of the strand 48 be terminated but maintained, the figure would remain in its then intermediate position. If on the other hand, the tensioning of the strand 48 were relaxed, the body 12 would return to its rest position shown in FIG. 4. If such relaxation or upward movement of the strand 48 is permitted to take place abruptly, the figure 12 will move from either a full lift position or some position intermediate thereof, immediately to a rest position simulating the collapse of a lifter as when unsuccessfully performing any portion of a lift sequence.

Figure 5:
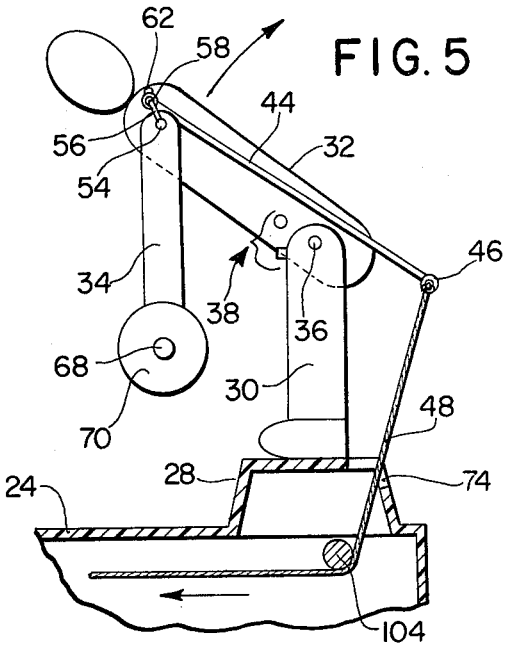

The movement of the figure from a full rest position to the simulated "clean" position is shown by reference to FIGS. 5 and 6 wherein initial tensioning of the strand 48 serves to move the upper portions of the torso 32 in a clockwise direction by reason of the outwardly offset positioning of the eyelet 46 with respect to the lower pivot 36, until the torso 32 is in an upright position in general longitudinal alignment with the leg portions 30. At such position, stops (not shown) which may be similar to the stop means 38 above indicated serve to prevent further clockwise motion to an overcenter position. Also, at that point upon further tensioning, the rod 44 is free to move downwardly with respect to the torso, such action initiating movements of arms 34 through the bell crank action previously described.

The arm portions 34 of the figure include shoulder portions 64 which, as previously explained, are pivotally attached to the torso and with hand portions 66 preferably spaced from each other as best shown in FIG. 1. These hand portions 66 are interconnected by a bar 68 simulating a weightlifting bar to which pairs of washers 70 simulating weights may be progressively added. Such weights 70, when not in use as by positioning on the bar 68, may be stored within recesses 72 provided within the top surface 24 of the base 14.

Figure 3:
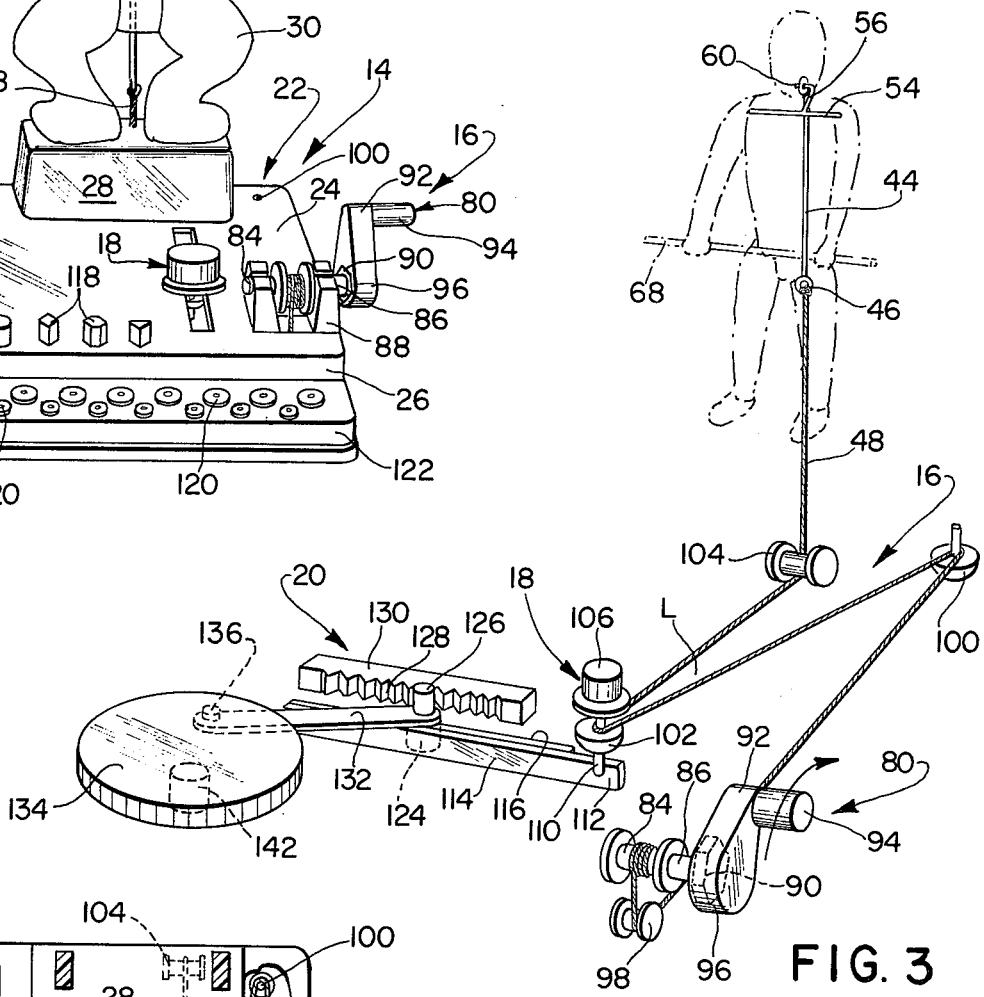
FIG. 3 is an enlarged exploded perspective view.
Figure 2:
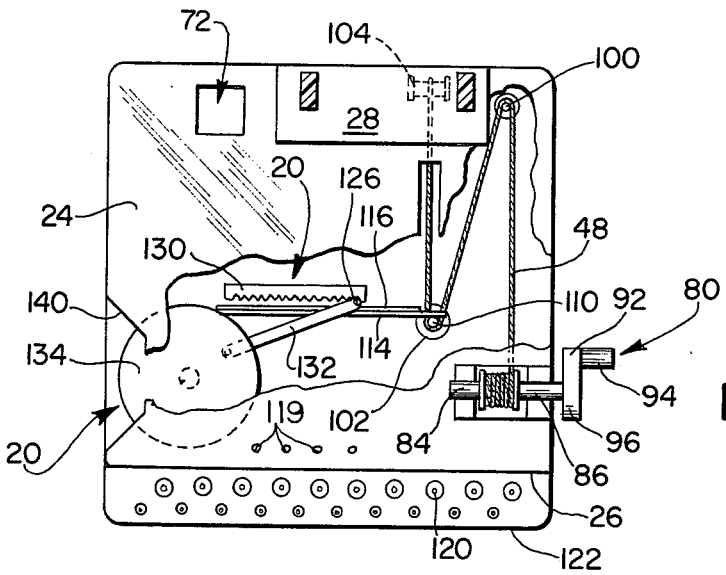
FIG. 2 is a top plan view thereof with parts removed for clarity.

Turning now to FIGS. 1 through 3 of the drawings, the construction and operation of the progressive tensioning means 16 is best shown. The strand 48 is accordingly adapted to run from its lower terminal connection with the rod 44 through a base opening 74 along a path including at least one loop L for shortening the extent of such path to a takeup device 80, such as a winding mechanism. The takeup 80 includes a winding drum 84 to which the opposite end of the strand 48 is attached. The drum is disposed on a winding shaft 86 in turn positioned within trunions 88 upwardly projecting from the platform 24. One end of the shaft 86 is provided with a blind head 90 of non-circular, i.e. hexagonal, configuration about which a crank 92 having an outwardly extending handle 94 and a similarly, i.e. hexagonally, configured inwardly extending recess 96 is positioned thereon so as to in effect form a slip clutch. More specifically, the handle 92 will slip about the head 90 so as to prevent undue tension from being applied to the strand 48 and thus prevent its breakage.

The strand 48 passes from the drum 84 over at least one and dependent upon the positioning of the takeup means 80, over a plurality of idler pulleys such as pulleys 98, 100, 102 and 104 shown. The pulley 102 is utilized to form the loop L in order to provide excess strand length whereby to enable the strand to abruptly become slack, as by the sudden movement of the pulley 102 from an initial tension position, as shown in FIG. 3, to a secondary or slack position more proximate to the body 12. The pulley 102 extends upwardly through a slot 108 formed in the platform 24 and is provided with a cap or keeper 106 at its upper extremity, whereby movement of the pulley 102 can only be along the path defined by slot 108, which path extends generally in a direction normal to the figure 12. It should be brought out that alternate path configurations of the strand 48 may be assumed dependent on the various positioning of the tension limiting means 18, the takeup device 80, and the various pulleys, one such alternate including the positioning of the takeup device 80 in line with that portion of the strand path passing between idler pulleys 102 and 104, i.e. the substitution of winding drum 84 for the idler pulley 104. Normally, however, it is desirable to position the takeup mechanism 80 conveniently with respect to player orientation as on forward portions of the platform 24.

A downwardly extending shaft 110 forming a portion of the idler pulley 102 is adapted to engage terminal portion 112 of a leaf spring 14, in turn fixedly positioned within the platform 22 by known means (not shown). The terminal portion 112 of the leaf spring is somewhat deflectable whereupon if sufficient tension is applied to the strand 48, the shaft 110 will cause the spring to deflect sufficiently to enable the shaft, and thus the idler pulley 102, to slip therepast and abruptly move along the entire extent of the slot 108 towards the figure 12. Such abrupt movement enables the strand 48 to at least momentarily go slack, thus permitting the body or figure 12, in whatever attitude it is at that moment, to immediately return to the rest position, thus simulating a collapse or unsuccessful lift. In order to stiffen body portions of the leaf spring, it is sometimes desirable to incorporate a second leaf spring 116 forwardly thereof with respect to its disposition with the figure 12 in order to arrive at flexibility characteristics within a desired range.

In operation of the game, a participant will place a group of weights 70 upon the bar 68 when the figure is in its rest position as indicated in FIG. 4 and then proceed to progressively tension the strand 48 by winding such up by means of the take up device 80. Thereafter if the total force, that is the predetermined tension limit needed to move the idler pulley 102 past the spring 114, is greater than that necessary to erect the figure to its full lift position, the progressive tensioning means 16 will move such figure through the intermediate positions shown in FIGS. 5 through 7 to its full or successful lift position shown in FIG. 8. However, if the force necessary to partly or completely move the figure through the positions depicted in FIGS. 4 through 8 is greater than the predetermined tension limit to move the idler 102 past the spring, then at some point during the erection of the figure, the idler pulley 102 will slip past the terminal portions 112 of the spring 114 and abruptly cause slack within the strand 48, thus permitting the figure to return or collapse to its rest position. A record of the score of the individual participants in the game may be kept by adding the total weights successfully lifted through the placement of a plurality of pegs 118 having a lower pin extension (not shown) adapted to fit into storage openings 119 and subsequently into a series of score openings 120 corresponding to weight delineations provided on a secondary platform 122 outwardly extending from the forward portion of the base 22.

In order to introduce a degree of suspense or uncertainty as to whether the FIG. 12 will be able to move to a full lift position with any given weight burden and thus to enhance the play value of the game, means for randomly varying the predetermined tension limit are provided. Such tension varying means 20 include a spring follower 124 adapted to slidably move along the longitudinal extent of the spring 114 on the inner surface thereof and in those cases where a second leaf spring is utilized, on the inner side of the leaf spring 116, so as to increase or decrease, dependent on its position, the flexibility of the terminal portion 112. The upper portion of the spring follower 124 includes a detent follower 126 upwardly extending therefrom and adapted for temporary receipt within a series of cutouts or grooves 128 formed in the forward portion of a detent mechanism 130. The detent mechanism 130 is spaced slightly inwardly of the spring 114 so that when detent follower 126 is positioned in one of the grooves 128, the spring follower 124 will be disposed closely adjacent the surface of the spring. The followers 124, 126 are movable by means of a crank arm 132 in turn connected to a wheel 134 by means of a pin 136. The wheel 134 is rotatably mounted within housing 22 by any suitable means, such as shaft 142 and platform 24 is cut away, as at 140, to permit access to wheel 134 for manual turning thereof. It may thus be seen that the operation of the tension varying means 20 is not readily visible to player participants and that by moving the wheel 134, the slide follower 124 is randomly positioned with respect to the spring 114 so that the stiffening effect thereof is not known to a player until a certain weight selection is attempted to be lifted. This added feature materially increases the play value of the toy above described, and as previously explained, has further utility with other toys or systems where it is desired to introduce an element of uncertainty as to whether a device may be successfully moved between rest and lift positions thereof. It should also be clear that the novel tension limiting means 18 comprising the interaction between the spring 114 and the idler pulley 102 has similar independent utility.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game including a device for performing work by strand tensioning wherein varying loads may be supported thereby, said device having at least one member movable from an initial position to a final position through the tensioning of a continuous strand operatively associated with said member, means for tensioning said strand so as to move said member from said initial to said final positions thereof, means carried by said game for setting a predetermined tension limit below which said strand may be tensioned to move said member from said initial to said final position, and above which said strand will automatically become slack enabling said member to return to said initial position and means for randomly varying said predetermined tension limit.

2. The game set forth in claim 1, wherein said device is a lifting device simulating a human weightlifter, said movable member comprising the arm portions thereof which in turn are adapted to receive varying weights in an initial rest position for attempted movement to a final lift position by means of the progressive tensioning of said strand, said weights varying the tension load required for said strand to move said member from said initial to said final position.

3. A strand tensioning device comprising a tension limiting member operatively associated with a strand and means to apply tension force to said strand in a strand direction opposed to said member, said member movable between a first position and a second position towards the direction of said force wherein said strand is adapted to be maintained taut when said member is in said first position and permitted to abruptly go slack in said second position, deflectable means adapted to contact said member to maintain such in said first position against the opposite force of said strand up to a predetermined force level, said means deflectable above said predetermined force level to permit passage of said member therepast to said second position, and means for varying said predetermined force level.

4. The device set forth in claim 3, wherein said deflectable means is a flexible leaf spring, a terminal portion of said leaf spring contacting said member in said first position and adapted to deflect a sufficient distance to permit said member to slip therepast above said predetermined force level.

5. The device set forth in claim 4, said leaf spring including a first segment and a second segment disposed in face-to-face contact therewith, said second segment positioned on that side of said first segment disposed towards the force direction and, terminating short of said terminal portion thereof to form stiffening means for said first segment.

6. The device set forth in claim 4, wherein said means for varying said predetermined force level comprises means for varying the flexibility of said leaf spring.

7. The device set forth in claim 6, wherein said means for varying the flexibility of said leaf spring comprises a spring follower adapted to slidably contact said leaf spring in varying positions therealong towards and away from said terminal portion thereof.

8. The device set forth in claim 7, including a detent positioned in general alignment with said spring and terminating short of said terminal portion thereof and spaced therefrom towards the direction of said strand force, including a detent follower associated with said spring follower and adapted to contact said detent to releaseably maintain said spring follower in a selected position and to urge said spring follower against said spring.

9. The device set forth in claim 8, said detent follower being an extension of said spring follower.

10. The device set forth in claim 7, said spring follower attached to a crank arm in turn pivotally connected to a wheel wherein rotation of said wheel varies said predetermined force level.

11. A toy including a base, a figure simulating a weightlifter supported by said base, said figure having leg, torso and arm portions interconnected so as to effect simulated weightlifting motions from a rest to a lift position, said leg portions fixedly positioned with respect to said base in a generally upright disposition, said torso pivotally connected to said leg portions at a lower pivot for free arcuate movement with respect thereto from an initial position wherein said torso is angularly disposed with respect to said leg portions to a final position wherein said torso and leg portions are in general upright alignment with each other, said interconnection further comprising in part said arm portions being pivotally mounted to said torso portion at an upper pivot for arcuate movement with respect to said torso, said arm portions having means for receiving weights, means for elevating said figure, said figure elevating means including strand means means connected to said strand means for applying tension to said strand means whereby said torso portion may first be pivoted about said leg portions from said initial angular position thereof to an intermediate figure position corresponding to said generally aligned leg and torso position and thereafter upon continued application of tension to said strand means, said arm portions of said body and said weights received thereby may be arcuately pivoted about said torso portion from a rest position to said lift position wherein said arm portions are disposed above said torso.

12. The toy construction of claim 11, including arm portion elevating means including rotatable means rotatable about said upper pivot, said rotatable means rigidly connected to said arm portions for simultaneous movement therewith whereby tensioning of said strand rotates said rotatable means thereby causing said arm portions to move upwardly from said intermediate figure position to said lift position.

13. The toy construction of claim 12, said rotatable means comprising a laterally extending pivot rod supported for at least partial rotation with respect to said torso, said arm portions rigidly connected to said pivot rod whereby rotation of said rod causes arcuate swinging movement of said arm portions.

14. The toy construction of claim 13, wherein said figure elevating means further comprises a rigid second rod connected to said torso and longitudinally movable with respect thereto, said second rod terminating at its upper end proximate said arm portion upper pivot and at its opposite lower end outwardly eccentric to said leg portion lower pivot, whereby strand tensioning initially arcuately moves said torso about said lower pivot to said generally aligned positioning of said leg and torso portions and sequentially thereafter moves said arm portions about said upper pivot to a lift position wherein said arm portions are generally longitudinally aligned with the remaining portions of said figure.

15. The toy construction of claim 14, the lower terminal portion of said rod including attachment means for said strand.

16. The toy construction of claim 15, said arm portion elevating means including a bell crank mechanism connected at one side thereof to said second rod at its upper end and at its other side in a rigid connection to said pivot rod.

17. The toy construction of claim 14, said bell crank mechanism including a shaft rigidly connected at one end thereof to said pivot rod and movably connected to said second rod at the other end thereof, whereby downward longitudinal movement of said second rod with respect to said torso causes said shaft to arcuately move about said pivot rod in the same direction that said arm portions swing about said pivot rod.

18. The toy construction of claim 16, said arm portions at the hands thereof interconnected by means of a laterally extending bar outwardly extending and terminating at ends disposed to either side of said hands, said bar ends adapted to receive weights, said arm portions and said bar integral with each other and received at shoulder portions thereof by said torso for arcuate movement as a unit about said upper pivot.

19. A toy including a base, a figure simulating a weightlifter supported by said base, said figure having leg, torso and arm portions interconnected so as to effect simulated weightlifting motions from a rest to a lift position, said interconnection comprising in part said arm portions being pivotally mounted to said torso portion at an upper pivot for arcuate movement with respect to said torso, said arm portions having means for receiving weights, means for elevating said arms, said arm elevating means including strand means, means connected to said strand means for applying tension to said strand means whereby said arms and the weights received thereby may be arcuately pivoted about said torso portion from a rest position to said lift position, and means for abruptly causing said strand to go slack above a predetermined tension limit so that said figure will automatically return to its rest position.

20. The toy construction of claim 19, said base including strand retaining means and winding means for applying tension at one end of said strand, the other end of said strand connected to said figure.

21. The toy construction of claim 20, said means for abruptly interrupting strand tensioning including tension limiting means having at least one idler means for receipt of a running length of said strand, said idler means positioned forwardly of said figure within a base slot and movable towards and away from said figure within said slot from a first position to a second position, said tension limiting means further including a leaf spring attached to said base and having a terminal portion thereof deflectable above a predetermined tension limit, said terminal spring portion adapted for positioning intermediate said figure and said idler means in contact with said idler means in said first position for forward restraint thereof, said idler means adapted to abruptly move past said spring when said predetermined tension limit is exceeded, thus producing immediate slack in said strand to consequently cause said figure to move to said rest position.

22. The toy construction of claim 21, including means for varying said predetermined tension limit.

23. The toy construction of claim 22, said tension limit varying means adapted to randomly select such limit, said base including a generally imperforate top wall, said limit varying means disposed beneath said top wall and generally obscured from view of a player so that said predetermined limit cannot be readily determined in normal play operation of the toy.

24. The toy construction of claim 23, said tension limit varying means comprising a spring follower adapted to slidably contact said leaf spring in varying positions along the extent thereof so as to vary the flexibility of the terminal portion of said spring, said follower in turn connected to a wheel and crank arm system, said wheel partially accessible from said top wall and supported by said base for rotation thereof so as to vary said predetermined tension limit.

* * * * *